US008756860B1

(12) United States Patent
Murphy

(10) Patent No.: US 8,756,860 B1
(45) Date of Patent: Jun. 24, 2014

(54) PLANT HANGER WITH WATERING SYSTEM

(76) Inventor: Kevin Murphy, Marion, IL (US)

( * ) Notice: Subject to any disclaimer, the term of this patent is extended or adjusted under 35 U.S.C. 154(b) by 139 days.

(21) Appl. No.: 13/208,448

(22) Filed: Aug. 12, 2011

(51) Int. Cl.
*A01G 17/06* (2006.01)

(52) U.S. Cl.
USPC ..... 47/47; 47/82

(58) Field of Classification Search
USPC ..... 47/39, 44, 47, 48.5, 65.5, 66.6, 67, 69, 47/82, 83
See application file for complete search history.

(56) References Cited

U.S. PATENT DOCUMENTS

| | | | | |
|---|---|---|---|---|
| 2,561,435 | A * | 7/1951 | Van Woodward | 135/15.1 |
| 3,991,978 | A * | 11/1976 | Jones | 254/335 |
| 4,194,319 | A | 3/1980 | Crawford | |
| 4,419,843 | A | 12/1983 | Johnson, Sr. | |
| 4,808,303 | A * | 2/1989 | Edwards et al. | 210/138 |
| 4,825,591 | A | 5/1989 | Han | |
| 5,598,662 | A | 2/1997 | Droste | |
| 5,752,341 | A * | 5/1998 | Goldfarb | 47/78 |
| 5,806,239 | A | 9/1998 | Wesolowski | |
| 5,974,731 | A | 11/1999 | Wesolowski | |
| 6,843,022 | B1 | 1/2005 | Holley | |
| 8,079,176 | B1 * | 12/2011 | Thead et al. | 47/29.6 |
| 2007/0101645 | A1 | 5/2007 | Christopher et al. | |

OTHER PUBLICATIONS

Vertical Gardening; Outreach and Extension, University of Missouri, Lincoln University; Mar. 25, 2010; p. 1.*

* cited by examiner

*Primary Examiner* — David Parsley
*Assistant Examiner* — Timothy Schwarz
(74) *Attorney, Agent, or Firm* — Robert C. Montgomery; Montgomery Patent & Design

(57) ABSTRACT

A plant hanger with a watering system includes a weighted base adapted for stable placement on a ground surface and an upwardly-extending support post. A plurality of adjustable hanger arms extends perpendicularly outward from a central hub affixed to the post. A watering system is connected to an existing water source, which delivers water to an inline plant food reservoir for introducing plant food into the water. The water is distributed to each arm through a water distributing manifold attached to an upper end of the post and in fluid communication with the water source.

17 Claims, 10 Drawing Sheets

PLANT HANGER WITH WATERING SYSTEM

RELATED APPLICATIONS

The present invention was first described in a notarized Official Record of Invention on May 28, 2010, that is on file at the offices of Montgomery Patent and Design, LLC, the entire disclosures of which are incorporated herein by reference.

FIELD OF THE INVENTION

The present invention relates generally to hanging plant supports, and in particular, to a plant hanger for supporting a plurality of suspendable growing containers having a watering system for automatically providing a regulated flow of water.

BACKGROUND OF THE INVENTION

Plants and flowers are a welcome addition to any decor. Their vibrant colors combined with their unique physical traits often form the centerpiece of a home or garden. Many people place such plants in pots in an outdoor environment to make planting and tending easier. Additionally, potted plants are aesthetically pleasing. However, a lack of horizontal surfaces in an indoor or outdoor environment means that there are very few places to locate such plants. The only real option is to hang them from an overhead structure such as a porch or tree limb. However, such structures are not always available, and even if they are, they tend to keep the plants in the shade and restrict their access to sunshine, which is vital to their growth.

Various types of plant hangers have attempted to address the problem of limited space by providing stands or poles for hanging various types of hangable flowers and vegetables. However, these alternatives also have various disadvantages and deficiencies related to design or utilization. Particularly, hanging plants typically need to be watered more often and in smaller amounts than those which are planted in the ground. This need requires regular manual watering of each plant that is suspended from the plant hanger. Not only is this process time consuming, it can also be messy and physically strenuous for those with diminished physical capacity. Additionally, these devices are typically not sturdy enough to support heavier plants, such as vegetables grown in inverted growing containers.

SUMMARY OF THE INVENTION

Accordingly, the inventor has recognized the aforementioned inherent problems and lack in the art and observed that there is a need for a means by which plants can be displayed in an outdoor environment without the disadvantages as described. In accordance with the invention, it is an object of the present embodiments to solve at least one (1) of these problems.

The inventor recognized these problems and has addressed this need by developing a plant hanger with watering system that allows for the secure support and care of hanging flowers and vegetables in an easy, effective, and aesthetically pleasing manner. The inventor has thus realized the advantages and benefits of providing a support post having a passageway for receiving a flow of water from an external water supply and a water distributing manifold attached to an upper end of the post which is in fluid communication with the passageway. A fixed hub is rigidly affixed circumferentially around an exterior of the post and a plurality of hanger arms in fluid communication with said manifold are attached around the fixed hub. Each hanger arm has a proximal end pivotably attached to the fixed hub and a distal end for distributing the flow of water to a suspendable growing container supported on the hanger arm distal end. A movable hub is movably attached circumferentially around an exterior of the post and a plurality of support arms are attached around the movable hub. Each support arm has a proximal end pivotably attached to the movable hub and a distal end pivotably attached to the hanger arm distal end. A pin is insertably attached to the post so secure the movable hub at a selectable vertical position. The plurality of hanger arms is height adjustable in response to vertical movement of the movable hub relative to the post.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
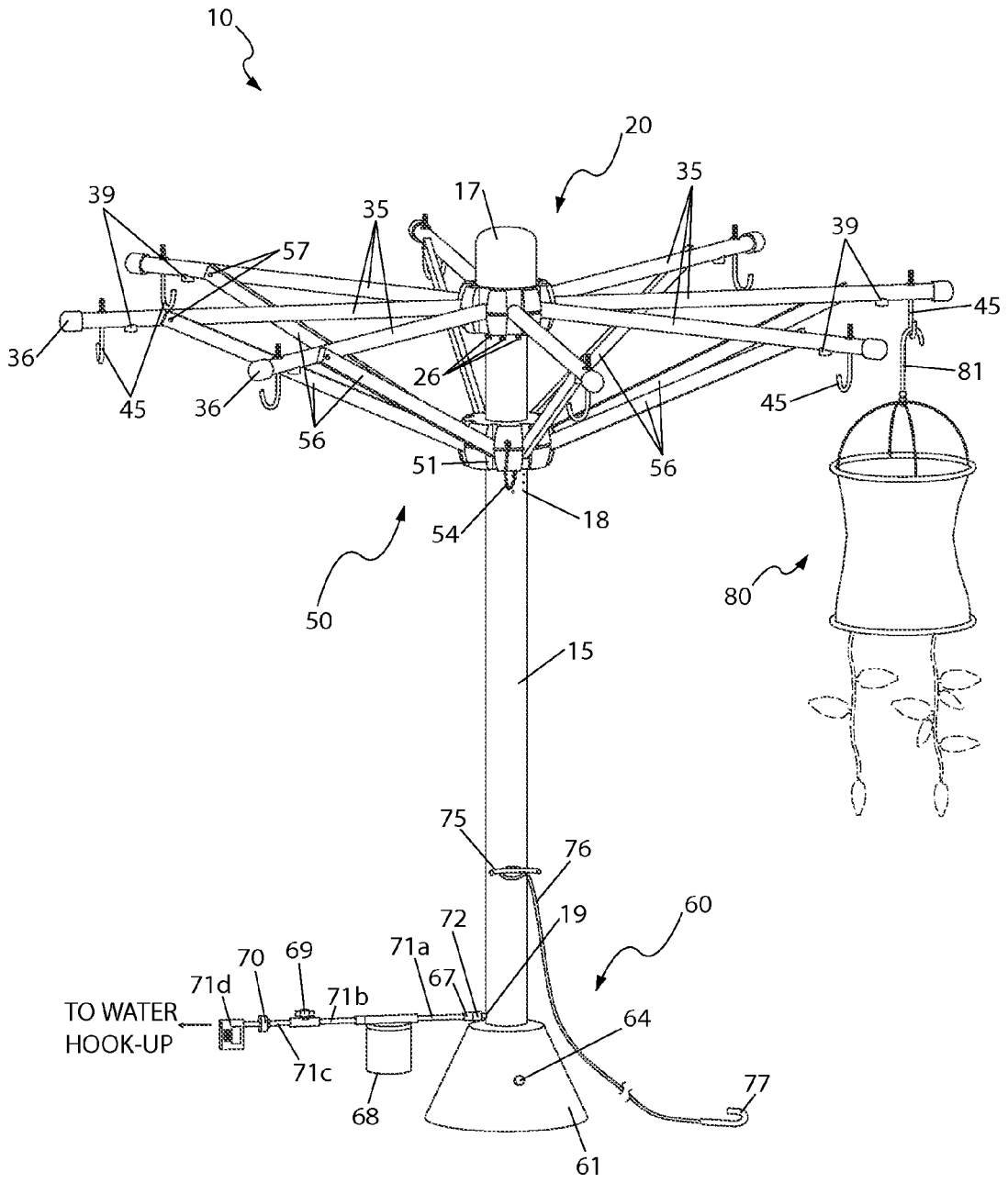
FIG. 1 is a perspective view of a plant hanger with a watering system depicted in a deployed state, according to a preferred embodiment in accordance with the invention.

10 plant hanger with a watering system
15 post
16 post internal portion
17 post cap
18 post aperture

19 water line aperture
20 upper portion
21 fixed hub
22 hanger arm guide
23 port aperture
24 fixed hub groove
25 securing wire
26 fixed hub bracket
27*a* first fastener
27*b* second fastener
27*c* third fastener
28 top aperture
30 manifold
31 port
32 manifold post
35 hanger arm
36 end cap
37 first wire aperture
38 arm cutout
39 drip valve
40 pipe
41 hose
42 water flow
45 hook
46 shaft
47 washer
50 middle portion
51 movable hub
52 support arm guide
53 movable arm groove
54 chain
55 pin
56 support arm
57 support arm pin
58 second wire aperture
60 bottom portion
61 base
62 base internal portion
63 weight material
64 base cap
65 filling aperture
66 water line
67 pressure regulator
68 feed reservoir
69 shutoff valve
70 hose connector
71*a* delivery hose
71*b* valve outlet hose
71*c* valve inlet hose
71*d* hose timer
72 water filter
75 tie-down
76 tie-down rope
77 tie-down hook
80 vegetation bag
81 bag hook
82 swivel
83 suspending line
84*a* upper ring
84*b* lower ring
85 expandable bag
86 bag aperture
87 sponge

DETAILED DESCRIPTION OF THE PREFERRED EMBODIMENT

In accordance with the invention, the best mode is presented in terms of a preferred embodiment, herein depicted within FIGS. 1 through 10. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 10, depicting a plant hanger with watering system (herein described as the "apparatus") 10, where like reference numerals represent similar or like parts. In accordance with the invention, the present disclosure describes an apparatus 10 for suspending and watering one or more hanging plants or other suspendable potted plants.

The apparatus 10 features an umbrella-style design which can be orientated in a deployed position (see FIG. 1) for displaying hanging plants or a collapsed position (see FIG. 2) for convenient storage. The apparatus 10 can be utilized with a plurality of vegetation bags 80 (see FIG. 10) and allows a user to set up a virtual garden in various locations.

Figure 2:
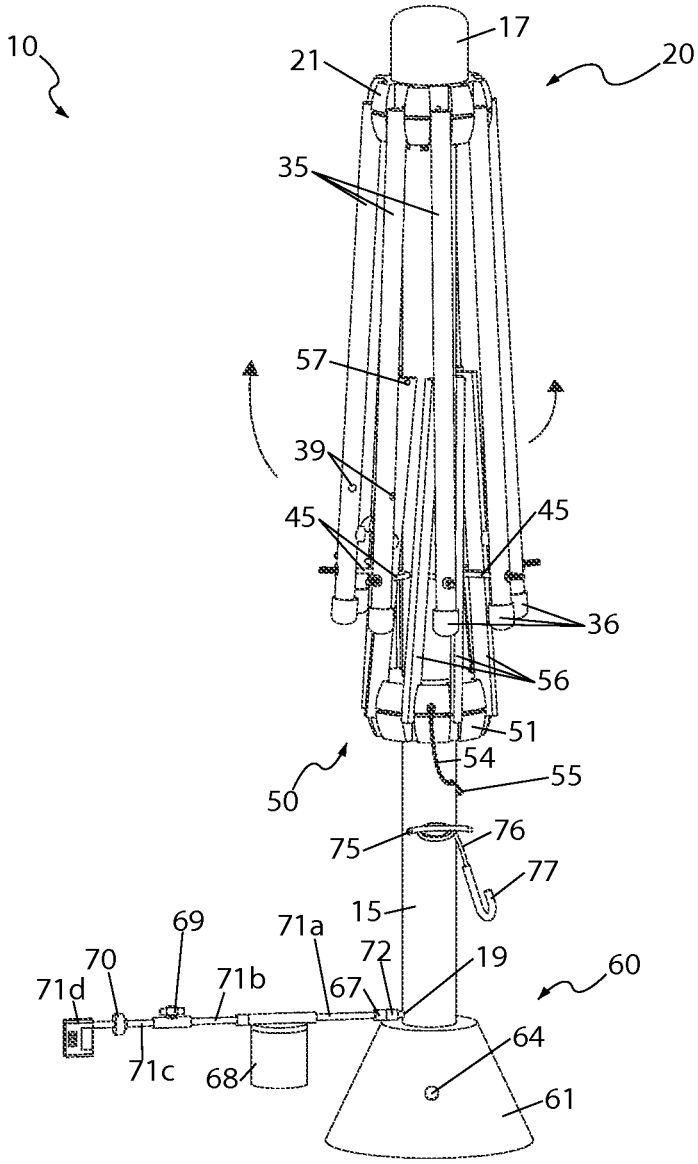
FIG. 2 is a perspective view of the plant hanger with a watering system depicted in a collapsed state, according the preferred embodiment.

FIG. 1 shows a perspective view of the apparatus 10 in an open and deployed state and FIG. 2 shows a perspective view of the apparatus 10 in a closed and collapsed state. The apparatus 10 includes an upper portion 20 (also see FIGS. 3 through 5), a middle portion 50 (also see FIGS. 6 and 7), and a bottom portion 60 (also see FIGS. 8 and 9). Each portion 20, 50, 60 is supported upon a post 15 which includes an outer diameter measuring approximately two-and-a-quarter (2¼) inches. The post 15 measures approximately eight (8) feet in height and is fabricated from materials such as, but not limited to: polyvinyl chloride (PVC), aluminum, or similar durable and lightweight material. A hollow post internal portion 16 allows for the routing of a length of water line 66 which is interconnected to a manifold 30 (see FIG. 9) for directing water flow 42 into the plurality of vegetation bags 80 or potted plants suspended from the upper portion 20 of the post 15.

The upper portion 20 includes a plurality of hanger arms 35 and the middle portion 50 includes a plurality of support arms 56 which provides a supporting structure to each vegetation bag 80 or hanging basket or potted plant. The middle portion 50 is vertically adjustable along the post 15 to a selected position. Vertical movement of the middle portion 50 relative to the post 15 simultaneously extends the hanger arms 35 upwardly and outwardly or downwardly and inwardly. The middle portion 50 is slid downward along the post 15 to collapse the hanger arms 35 and support arms 56 for storage purposes. The bottom portion 60 secures the post 15 in a vertical position and supplies the apparatus 10 with water, plant food, or the like which is dispensed through the hanger arms 35 and into the vegetation bags 80.

The post 15 also includes a tie-down 75 which provides a protrusion to wrap and secure a length of tie-down rope 76 for temporary securing a single vegetation bag 80 with a tie-down hook 77. The tie-down 75, tie-down rope 76, and tie-down hook 77 are intended to be used to temporarily suspend the vegetation bag 80 while the user is preparing the vegetation bag 80 for suspension from a hook 45 disposed upon each arm 35. In use, the tie-down hook 77 is attached to the vegetation bag 80 and the tie-down rope 76 is draped over a selected hook 45 in order to suspend the vegetation bag 80 at approximately waist height while filling with soil and a plant.

The tie-down rope 76 can then be used to hoist the filled vegetation bag 80 up to the hook 45 for transfer. The tie-down rope 76 is wrapped around the tie-down 75 when not in use. The tie-down 75 is a generally "T"-shaped protrusion integrally molded or otherwise affixed to an exterior surface of the post 15. The tie-down 75 is disposed approximately thirty-six (36) inches above an upper surface of the bottom portion 60. The tie-down rope 76 can be a nylon rope measuring approximately twelve (12) feet in length and three-sixteenths (3/16) of an inch in diameter having the tie-down hook 77 attached to an end.

Figure 3:
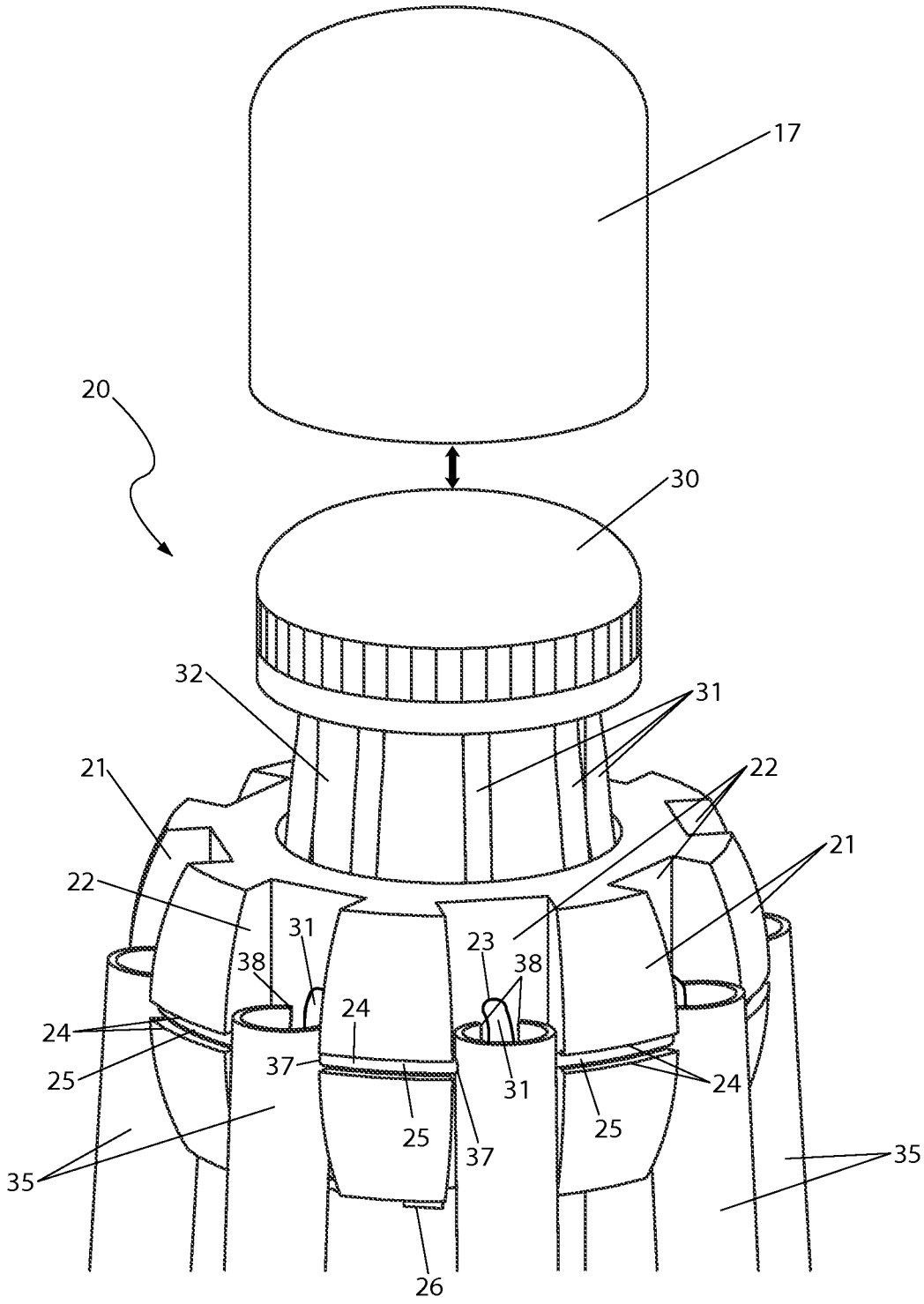
FIG. 3 is a close-up perspective view of an upper portion of the plant hanger with watering system, according to the preferred embodiment.
Figure 4:
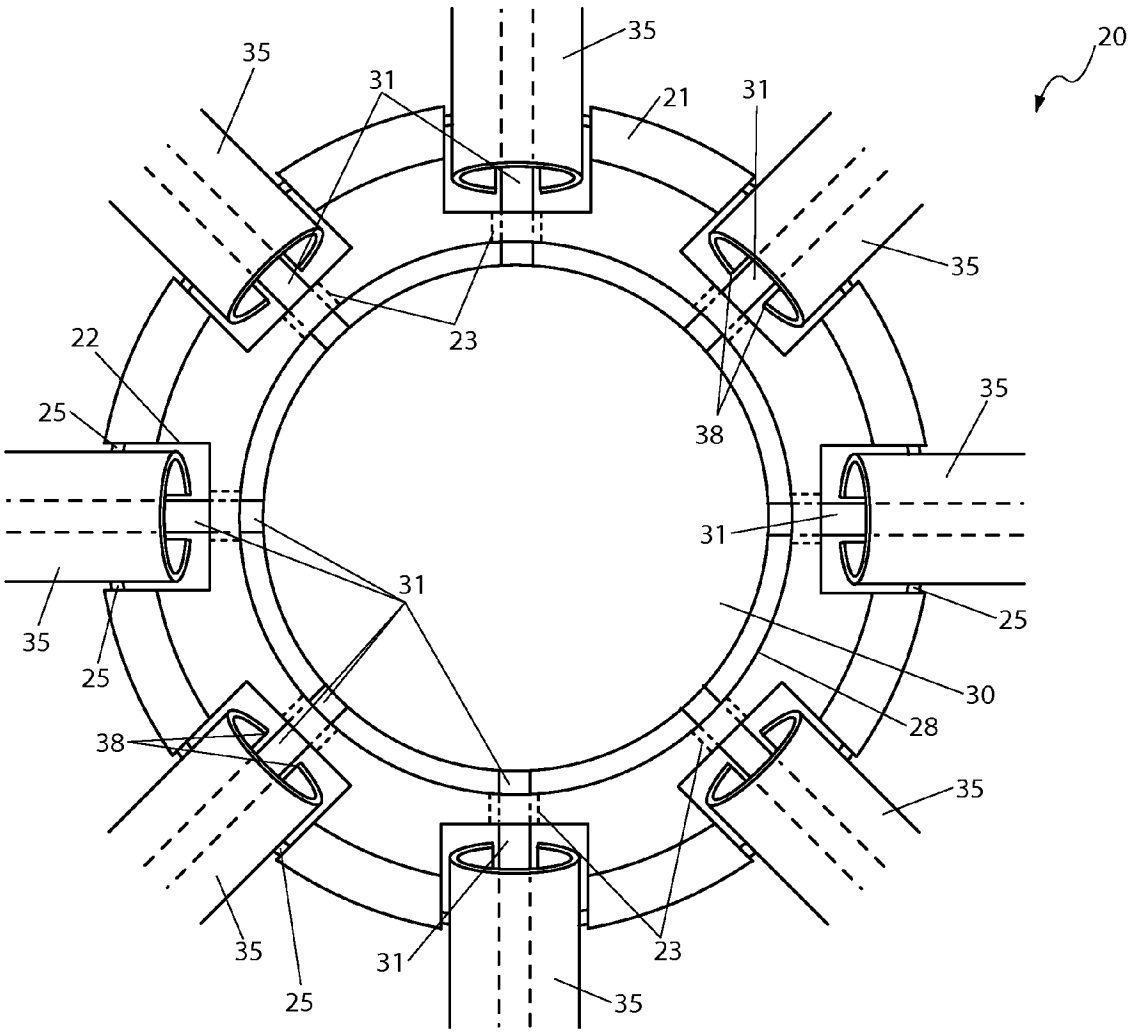
FIG. 4 is a top view of the plant hanger with a watering system, according to the preferred embodiment.
Figure 5:
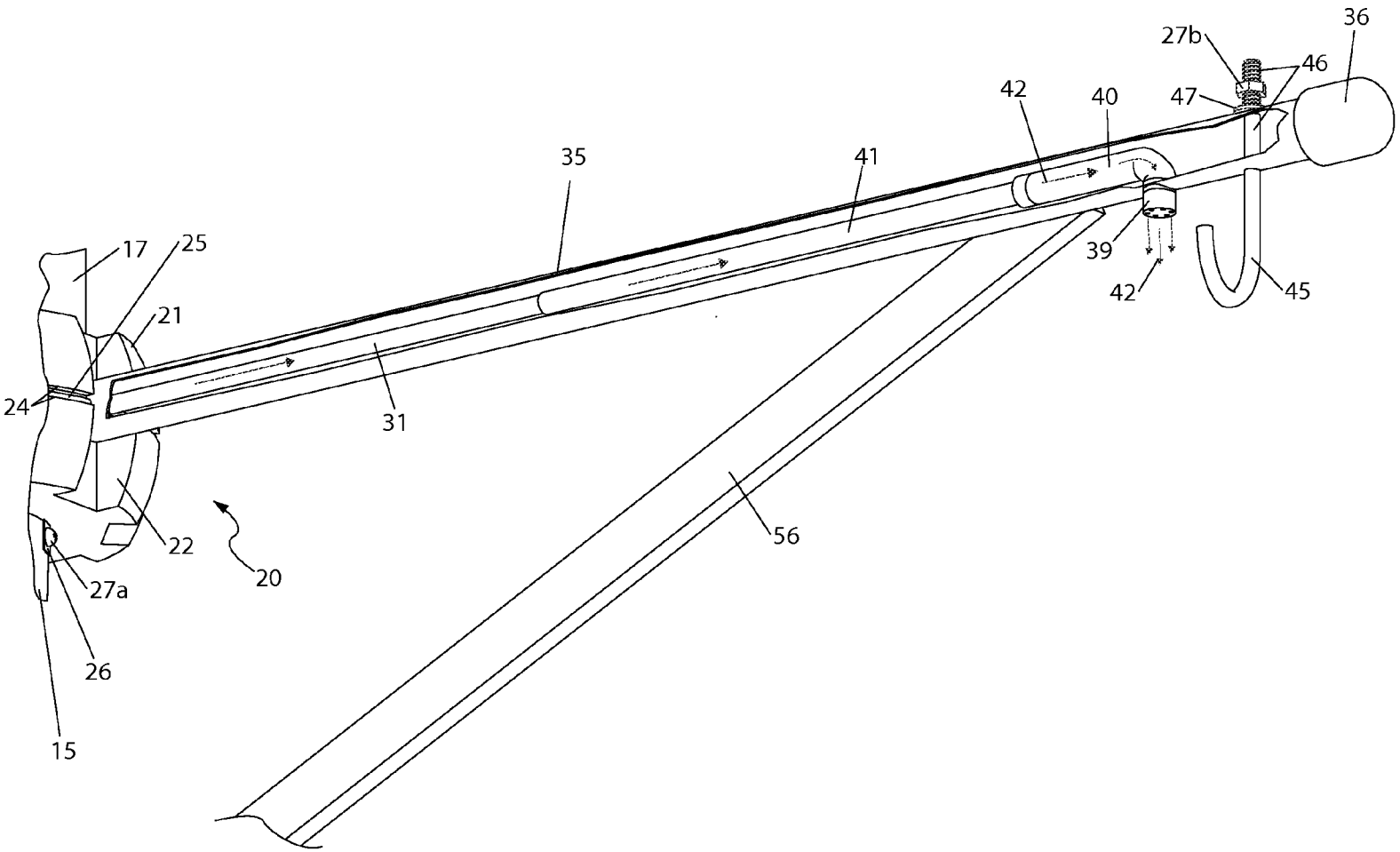
FIG. 5 is a partial perspective view of the upper portion of the plant hanger with a watering system, according to the preferred embodiment.

FIG. 3 shows a close-up perspective view of the upper portion 20; FIG. 4 shows a top view of the apparatus 10; and, FIG. 5 shows a perspective view of the upper portion 20. The upper portion 20 is located at a proximal end of the post 15 and includes a donut-shaped fixed hub 21. The fixed hub 21 comprises at least eight (8) hanger arms 35 which are radially spaced and hingedly attached around a perimeter of the fixed hub 21. The fixed hub 21 includes a plurality of hanger arm guides 22 which are cut-out portions which correspond to respective hanger arms 35 for the hanger arms 35 to fit within the arm guides 22 and freely rotate upwardly or downwardly. The fixed hub 21 also includes a fixed hub groove 24 disposed along an intermediate perimeter position. The fixed hub groove 24 receives placement of a length of securing wire 25 which is routed within the fixed hub groove 24 and through each arm 35. A single length of securing wire 25 is utilized to secure all of the hanger arms 35 to the fixed hub 21. The securing wire 25 is preferably twelve (12) gauge wire, yet similar dimensions can be utilized. A proximal end of each hanger arm 35 includes a pair of opposing first wire apertures 37 through which the securing wire 25 is threaded to provide a hinging motion to the arms 35. The wire apertures 37 are suitably sized to insertingly receive the securing wire 25.

The fixed hub 21 can be fabricated from durable materials such as, but not limited to: wood, plastic, metal, or the like. The fixed hub 21 is secured to the post 15 by a plurality of equally spaced fixed hub brackets 26. The fixed hub brackets 26 are preferably "L"-shaped brackets attached to an exterior surface of the post 15 and a bottom surface of the fixed hub 21 with mechanical first fasteners 27*a*, yet other methods of rigid attachment can be utilized without limiting the scope of the apparatus 10.

Each hanger arm 35 has a generally circular cross-section and is approximately thirty (30) inches in length and one (1) inch in diameter. The hanger arms 35 are fabricated from a similar material as the fixed hub 21. Each hanger arm 35 includes the first wire apertures 37 for routing of the securing wire 25 for attachment to the fixed hub 21. The first wire apertures 37 can be lined with a plastic tubing to reduce friction and limit fraying of the securing wire 25. Each proximal end of the hanger arms 35 also includes an arm cutout 38 which is located on an underside surface. The cutout 38 allows the hanger arms 35 to rotate to the deployed or collapsed position without crimping or bending of a port 31. The cutouts 38 measure approximately one half (½) inch in width by two (2) inches in length. The proximal end of each hanger arm 35 is preferably beveled to further allow a free rotation within the arm guides 22.

Each hanger arm 35 comprises a port 31 which is integral to the manifold 30 and routed through the hanger arms 35 to enable a flow of fluid. The ports 31 are preferably a quarter (¼) inch vinyl drip hose. The ports 31 are directed from the manifold 30 through a port aperture 23 in the fixed hub 21 and through a respective arm 35. The fixed hub 21 comprises a top aperture 28 which measures approximately three (3) inches in diameter to receive a manifold post 32 of the manifold 30 which is positioned within an open upper portion of the fixed hub 21. The manifold 30 is preferably a pressure regulating drip manifold with pattern control, such as those manufactured by Hendrickson Bros., Corona, Calif., or similar a pressure regulating and low volume drip irrigation mechanism. The manifold 30 includes an inlet which is interconnected to the internal water line 66 (see FIG. 9) which directs water flow 42 to the manifold 30 for dispersal through each port 31 and through each hanger arm 35 for watering the vegetation bags 80. The manifold 30 is further covered by a post cap 17 having cylindrical shape to cover the manifold 30 in order to prohibit dirt and debris from entering the apparatus 10. The post cap 17 also provides an aesthetically cohesive appearance to the apparatus 10.

Within each arm, the ports 31 are interconnected to a length of hose 41. The hose 41 is connected to and terminates at a pipe 42. The pipe 42 has a generally ninety degree (90°) bend for connection to an exposed drip valve 39. The drip valve 39 is integrally molded to or insertingly attached to an underside distal end of each hanger arm 35. It can be appreciated that the connections of the port 31 to the hose 41 and the hose 41 to the pipe 42 are completed with connection devices such as, but not limited to: threaded connections, slip fittings, or similar plumbing connections which are known in the art of pipe manufacturing and design. The drip valve 39 drips water into the respective vegetation bag 80 for watering purposes. The vegetation bag 80 or similar hanging plant is suspended to the distal end of each hanger arm 35 by a hook 45. The hook 45 includes a shaft 46 which is insertingly attached to each hanger arm 35 and secured at an upper distal surface of each the hanger arm 35 with a washer 47 and a second fastener 27*b*. The end portion of each hanger arm 35 includes an end cap 36 to eliminate dirt and debris from entering the arms 35. The end caps 36 are preferably slip fitted onto each hanger arm 35 and can also be adhered for additional securing purposes.

Figure 6:
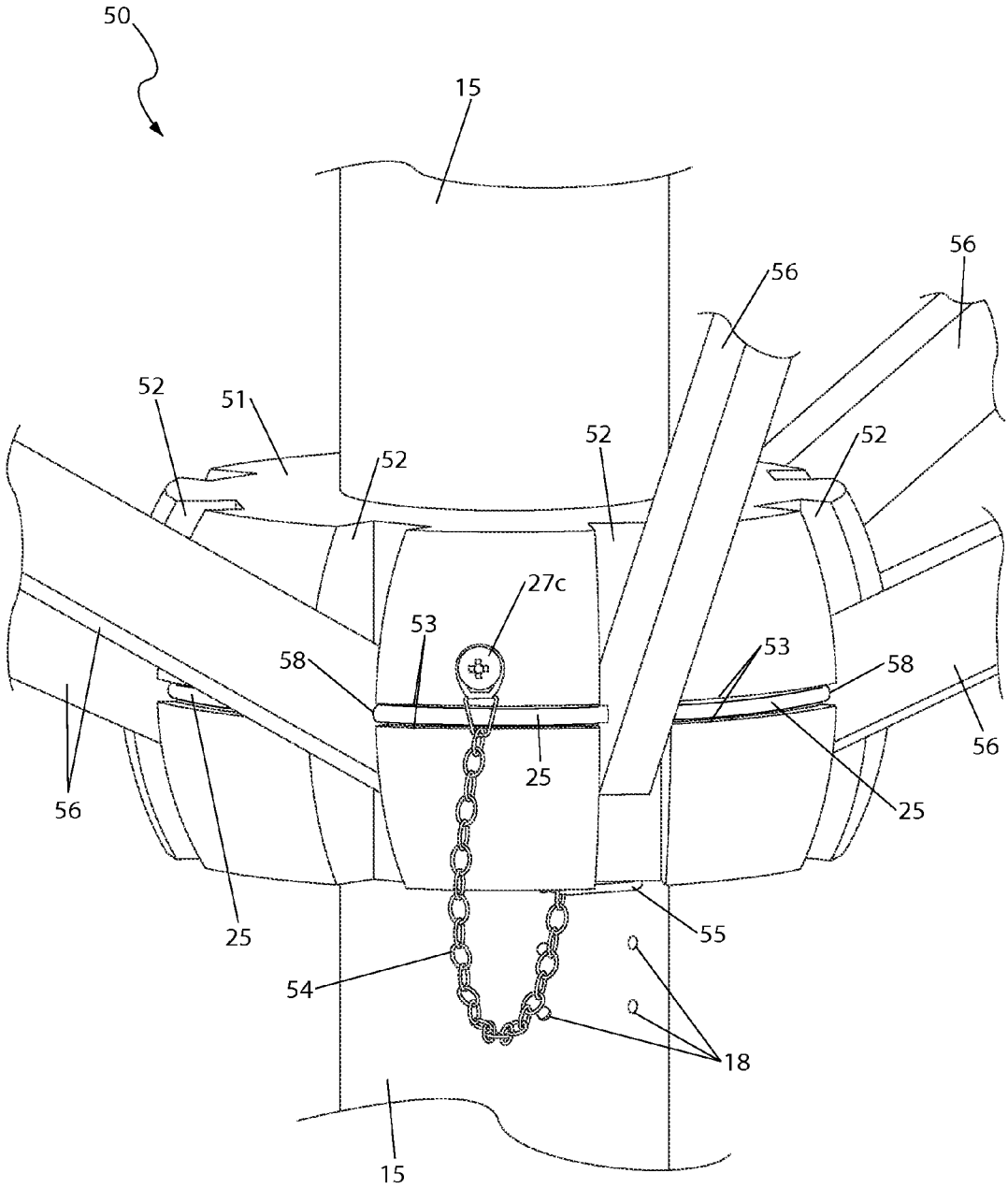
FIG. 6 is a close-up perspective view of a middle portion of the plant hanger with a watering system, according to the preferred embodiment.
Figure 7:
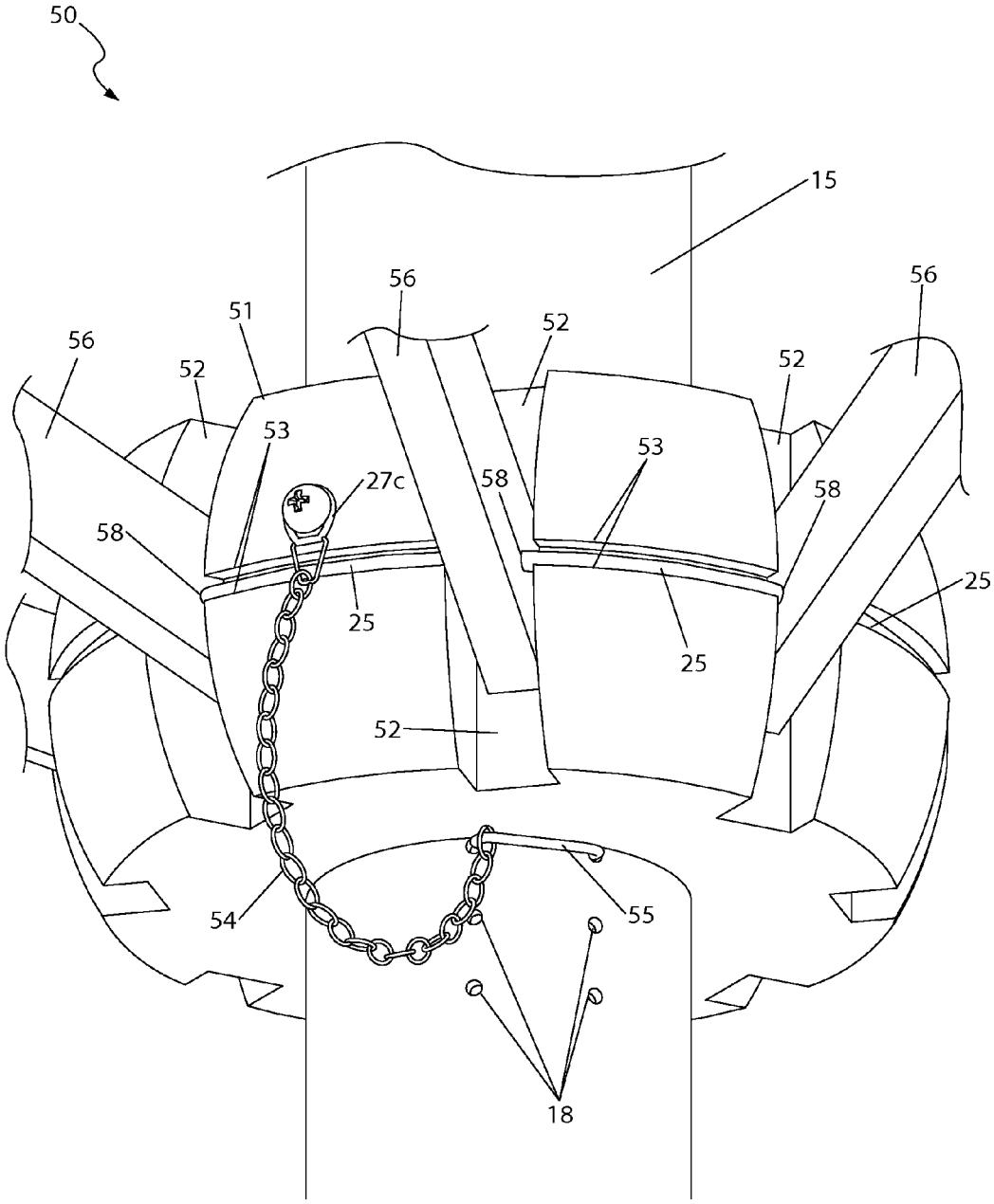
FIG. 7 is a close-up perspective view of the middle portion of the plant hanger with watering system, according to the preferred embodiment.

FIG. 6 and FIG. 7 show close-up perspective views of the middle portion 50. The middle portion 50 is generally located at an intermediate location upon the post 15 and is a donut-shaped and height-adjustable movable hub 51 having an internal diameter of approximately three (3) inches to allow placement upon the post 15. The movable hub 51 includes at least eight (8) support arms 56 which correspond to the hanger arms 35 and are radially spaced around and hingedly attached to the movable hub 51. The movable hub 51 also includes support arm guides 52 which are cut-out portions of the movable hub 51 and which correspond to the support arms 56 to allow the support arms 56 to fit within the support arm guides 52 and freely rotate upwardly or downwardly.

The movable hub 51 also includes a movable arm groove 53 disposed along an intermediate perimeter position. The movable arm groove 53 receives placement of a second length of securing wire 25 which is routed within the movable arm groove 53 and through each support arm 56. A single length of securing wire 25 is utilized to secure all of the support arms 56. The proximal end of each support arm 56 includes a pair of opposing second wire apertures 58 which receive the securing wire 25 which is threaded therethrough and provides a hinging feature to the support arms 56. The second wire apertures 58 are suitably sized to insertingly receive the securing wire 25. The second wire aperture 58 can be lined with a plastic tubing to prohibit fraying of the securing wire 25. The movable hub 51 is fabricated from materials which are similar to the fixed hub 21.

Each support arm 56 has a generally rectangular cross section and is approximately twenty-three (23) inches in length. The support arms 56 are fabricated from a similar material as the arms 35. The proximal end of each support arm 56 can be beveled to allow a free rotation within the support arm guides 52. Each support arms 56 is pivotally attached to the distal end of a corresponding hanger arm 35 by a support arm pin 57. The securing pin 57 allows the support arms 56 and hanger arms 35 to be concurrently positioned in the selected position.

The movable hub 51 is positionable at a selected height upon the post 15 by upward and downward sliding motion. The movable hub 51 is secured in the selected position by a pin 55 which is insertable within one of a plurality of post apertures 18. The plurality of post apertures 18 includes pairs of parallel and adjacent through holes which are located on a side surface of the post 15 and are preferably four (4) inches apart. The first pair of apertures being approximately twelve (12) inches from the top of the post 15. The pin 55 is attached to a free end of a chain 54. The opposing end of the chain 54 is attached to the movable hub 51 by a third fastener 27*c*.

Figure 8:
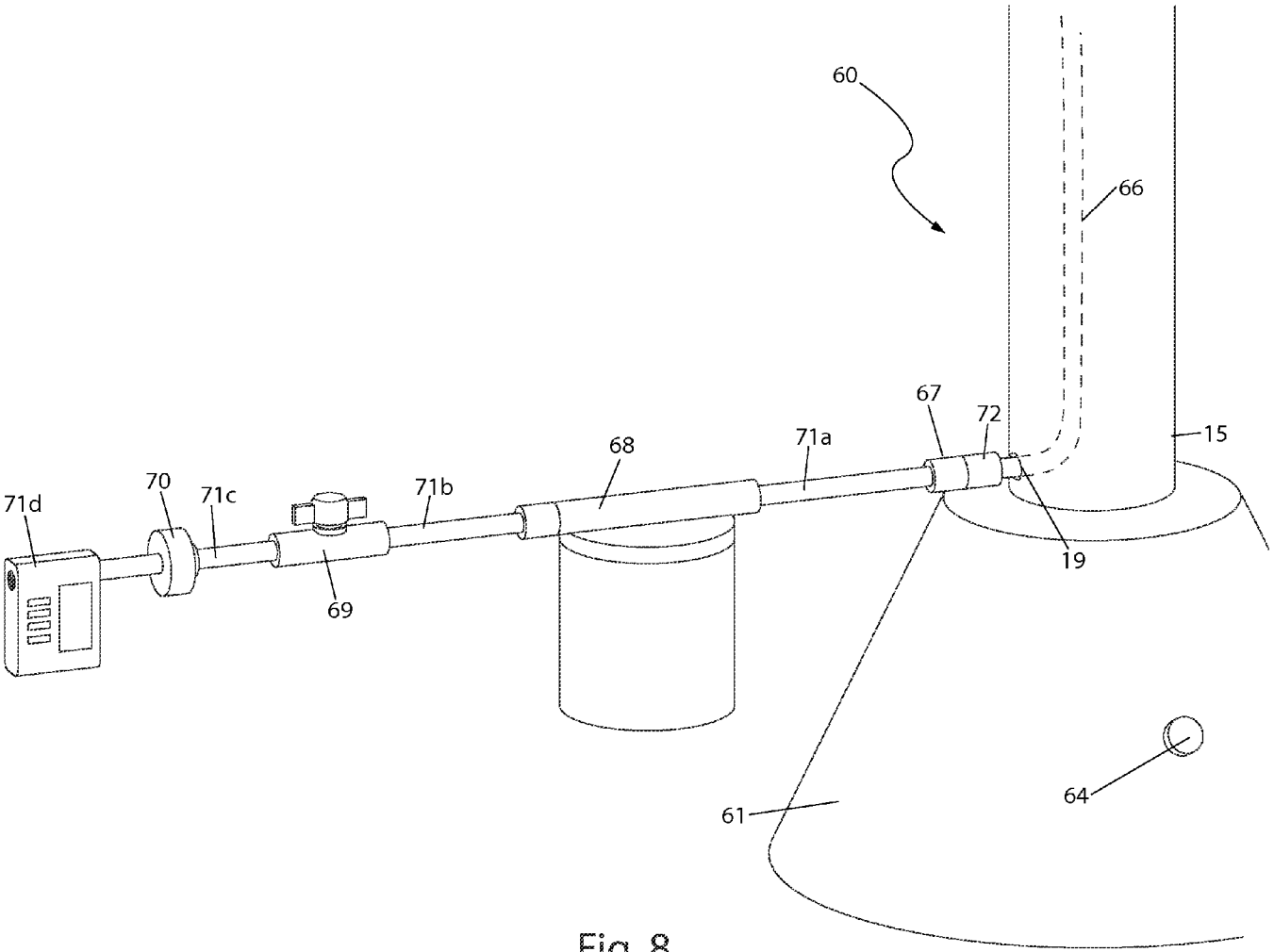
FIG. 8 is a perspective view of a bottom portion of the plant hanger with a watering system, according to the preferred embodiment.
Figure 9:
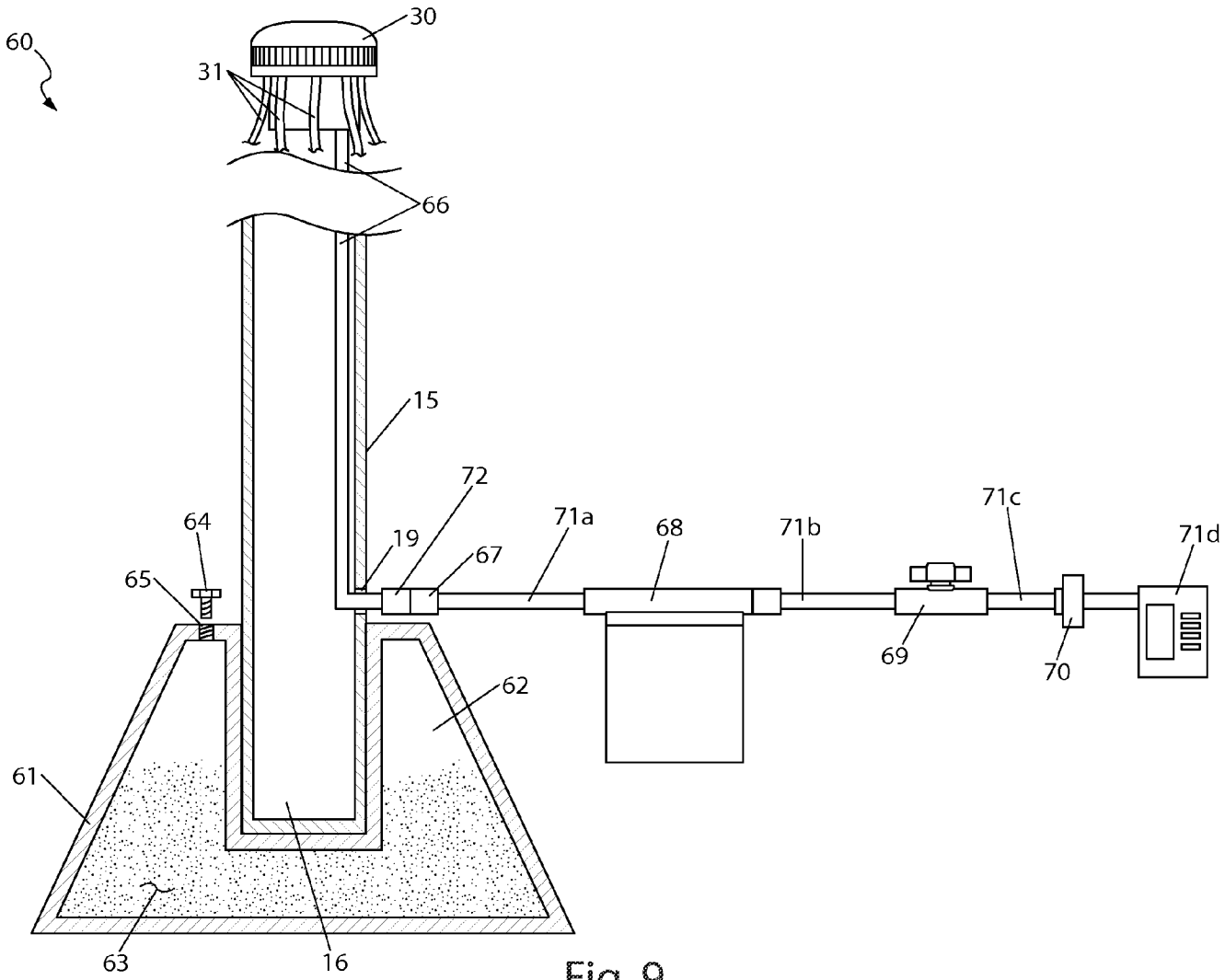
FIG. 9 is a section view of the bottom portion of the plant hanger with a watering system, according to the preferred embodiment; and, FIG. 10 is a perspective view of a vegetation bag, according to the preferred embodiment.

FIG. 8 shows a perspective view of a bottom portion 60 of the apparatus 10 and FIG. 9 shows a section view of the bottom portion 60. The bottom portion 60 rests on a generally flat support surface and positions the post 15 in a vertical orientation. The bottom portion 60 also provides the apparatus 10 with the water flow 42. The bottom portion 60 includes a cone-shaped base 61 which accepts a lower end of the post 15 and stabilizes the apparatus 10. The base 61 measure approximately thirty-six (36) inches in diameter. The base 61 includes a base internal portion 62 which is filled with a weighted material 63 such as water, sand, or the like. The base 61 is filled with the weighted material 63 by removing a threaded base cap 64 from a filling aperture 65. It can be appreciated that other methods of weighing-down the apparatus 10 or otherwise securing the base 61 to a floor or ground surface can be utilized without limiting the scope of the invention.

The post 15 is affixed or integrally molded within a generally central location of the base 61 to center and balance the apparatus 10 when the hanger arms 35 are deployed. Approximately fifteen (15) inches from the bottom of the post 15 is a water line aperture 19 which provides for access connection of the water line 66 to a water source, such as a faucet or spigot. The water line aperture 19 measures approximately one (1) inch in diameter. The water line 66 is optionally connected to a pressure regulator 67 and water filter 72, if additional regulation and filtration is needed or where the manifold 30 does not provide adequate regulation or filtration. The water filter 72 prevents particulates and debris from clogging the ports 31. Connected to the pressure regulator 67 is a delivery hose 71*a* which is removably attached to and is in fluid communication with a feed reservoir 68. The feed reservoir 68 includes a storage container which can provide the vegetation bags 80 with additional powdered or liquid nutrients. Connected to the feed reservoir 68 is a valve outlet hose 71*b* which is removably attached to and is in fluid communication with a manual shutoff valve 69. The manual shutoff valve 69 allows the user to cease water flow 42 into the apparatus 10. The shutoff valve 69 is preferably a manually-operated two-way ball valve or similar fluid regulating mechanism. Connected to the shutoff valve 69 is a valve inlet hose 71*c* which is attached to and is in fluid communication with a hose connector 70. The hose connector 70 interconnects the apparatus 10 to the water source. The hose connector 70 is depicted as also being connected to a hose timer 71*d*, which can allow the user to preset a length time for which the automatic watering of the vegetation bags 80 will occur. Each hose 71*a*, 71*b*, 71*c* is preferably a vinyl hose with compatible end attachments to removably connect the various components.

Figure 10:
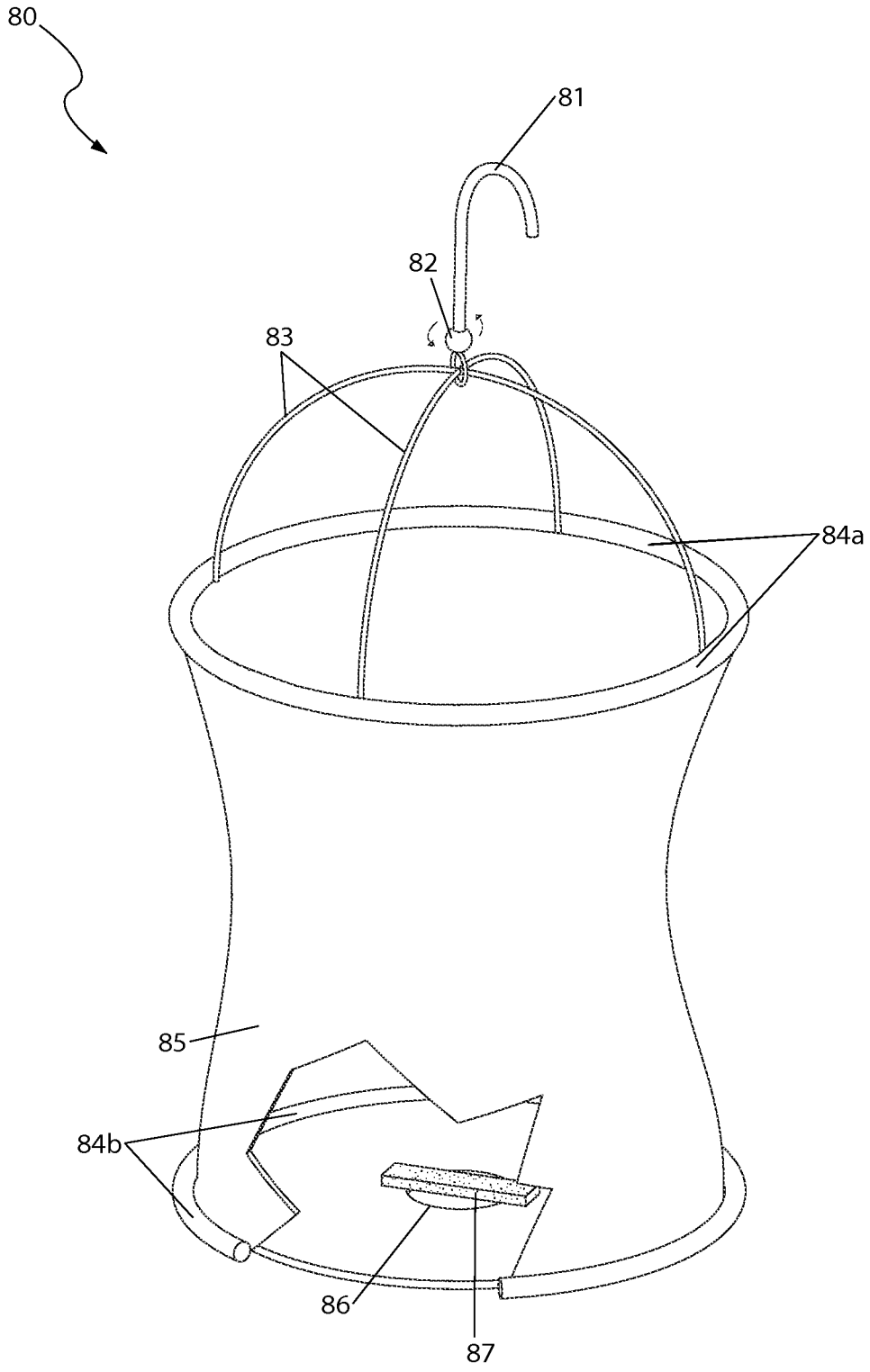

FIG. 10 shows a perspective view of the vegetation bag 80. The apparatus 10 can include a plurality of vegetation bags 80 or can be used with any similar hangable or suspendable growing containers. The vegetation bag 80 contains a plant along with the dirt needed for the plant to grow. Plants within the vegetation bag 80 grow upside down which promote growth and healthier fruits. The vegetation bag 80 includes an upper ring 84*a* and a lower ring 84*b* which create the supporting structure for the vegetation bag 80. Connected between the rings 84*a*, 84*b* is an attached expandable bag 85 which is fabricated from an expandable plastic mesh material. An upper end of the vegetation bag 80 is open to allow placement of soil, plants, water, or the like and a bottom end is closed except for an intermediately positioned bag aperture 86 through which the plant can grow. A sponge 87 is placed on top of the plant and bag aperture 86 to assist in holding the plant in position and prevent the plant from falling through the bag aperture 86. The vegetation bag 80 is suspended from the hooks 45 by a bag hook 81. The bag hook 81 is integral to a swivel 82 which allows rotation of the vegetation bag 80. The swivel 82 is connected to a plurality of suspending lines 83, each of which is attached to the upper ring 84*a*.

It can be appreciated by one skilled in the art that other styles and configurations of the invention can be easily incorporated into the teachings of the present disclosure and only two (2) particular configurations have be shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIGS. 1 through 8.

The method of installing and utilizing the apparatus 10 can be achieved by performing a plurality of steps, including but not limited to the following. Acquiring the apparatus 10 and positioning the base portion 60 on a level surface. Sliding the movable hub 51 upwardly upon the post 15 to extend the hanger arms 35 and support arms 56 to the selected position. Inserting the pin 55 within an appropriate post aperture 18 to secure the movable hub 51 at the selected position. Routing the tie-down rope 76 upwardly to drape over a hook 45 on a selected hanger arm 35 and suspending the vegetation bag 80 from the tie-down hook 77. Filling the vegetation bags 80. Suspending the vegetation bags 80 upon the hook 45 when filling is complete. Wrapping the tie-down rope 76 on the tie-down 75 when utilization is completed. Connecting the hose timer 71*d* to the hose connector 70 and connecting the water source to the hose timer 71*d*, thereby providing water flow 42 through the delivery hose 71*c*, shutoff valve 69, valve outlet hose 71*b*, feed reservoir 68, valve inlet hose 71*a*, pressure regulator 67, water filter 72, water line 66, and to the manifold 30. Dispensing the water flow 42 through the hanger arms 35 and out of each drip valve 39 to water the plants within the vegetation bags 80.

A method of disassembling and storing the apparatus 10 can be achieved by performing a plurality of steps including but not limited to the following. Removing the vegetation bags 80. Removing the pin 55 from the post aperture 18 to lower the movable hub 51 and collapse the hanger arms 35 and support arms 56.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A plant hanger with a watering system comprising:

a support post having a passageway for receiving a flow of water from a water supply;

a water distributing manifold attached to an upper end of said post and in fluid communication with said passageway;

a fixed hub rigidly affixed circumferentially around an exterior of said post, said fixed hub comprising a plurality of hanger arm guides spaced around a circumference of said fixed hub, each hanger arm guide comprising a recess extending radially inward from said circumference of said fixed hub;

a plurality of hanger arms in fluid communication with said manifold, each having a proximal end pivotably attached to said fixed hub within a corresponding hanger arm guide of said plurality of hanger arm guides and a distal end for distributing said flow of water to a suspendable growing container supported on said hanger arm distal end;

a movable hub movably attached circumferentially around an exterior of said post, said movable hub comprising a plurality of support arm guides spaced around a circumference of said movable hub, each support arm guide comprising a recess extending radially inward from said circumference of said movable hub;

a plurality of support arms, each having a proximal end pivotably attached to said movable hub within a corresponding support arm guide of said plurality of support arm guides and a distal end pivotably attached to said hanger arm distal end;

a pin insertably attached to said post to secure said movable hub at a selectable vertical position;

wherein said plurality of hanger arms are height adjustable in response to vertical movement of said movable hub relative to said post; and wherein said plurality of hanger arms is configured to be collapsed to a substantially vertical position within said plurality of hanger arm guides and said plurality of support arms is configured to be collapsed to a substantially vertical position within said plurality of support arm guides.

2. The plant hanger of claim 1, wherein said manifold further comprises a pressure regulating and low volume drip irrigation mechanism.

3. The plant hanger of claim 2, wherein each of said plurality of hanger arms further comprises:

a hollow elongated tubular member;

a flexible port in fluid communication with said manifold extending longitudinally through said tubular member; and, a drip valve protruding from said hanger arm distal end and in fluid communication with said port for dispensing a regulated flow of water to said suspendable growing container.

4. A plant hanger with a watering system comprising:

a hollow central support post having a water line extending longitudinally between an upper end and a lower end for receiving a flow of water;

a weighted base attached to said post lower end for supporting said post in an upright position;

a water distributing manifold attached to an upper end of said post and in fluid communication with an upper end of said water line;

a fixed hub attached around said upper portion of said post below to said manifold, said fixed hub comprising a plurality of spaced apart arm guides spaced around a circumference of said fixed hub, each hanger arm guide comprising a recess extending radially inward from said circumference of said fixed hub;

a movable hub slidably attached around said post below said fixed hub, said movable hub comprising a plurality of spaced apart support arm guides spaced around a circumference of said movable hub, each support arm guide comprising a recess extending radially inward from said circumference of said movable hub;

a plurality of hanger arms extending radially outward from said fixed hub and in fluid communication with said manifold for distributing said flow of water to a suspendable growing container, each of said plurality of hanger arms comprising a proximal end pivotably attached to said fixed hub within a corresponding hanger arm guide of said plurality of hanger arm guides such that said hanger arms are freely rotatable within said arm guides; and, a plurality of support arms extending radially outward from said movable hub, each of said plurality of support arms comprising a proximal end pivotably attached to said movable hub within a corresponding support arm guide of said plurality of support arm guides such that said support arms are freely rotatable within said support arm guides and an opposing distal end pivotably attached to said hanger arm distal end;

wherein said plurality of hanger arms are height adjustable relative to said fixed hub when said movable hub is vertically adjusted; and wherein said plurality of hanger arms is configured to be collapsed to a substantially vertical position within said plurality of hanger arm guides and said plurality of support arms is configured to be collapsed to a substantially vertical position within said plurality of support arm guides.

5. The plant hanger of claim 4, wherein each of said plurality of hanger arms further comprises:

a hollow elongated tubular member;

a flexible port in fluid communication with said manifold extending longitudinally through said tubular member; and, a drip valve protruding from said hanger arm distal end and in fluid communication with said port for dispensing a regulated flow of water to said suspendable growing container.

6. The plant hanger of claim 5, wherein said manifold further comprises a pressure regulating and low volume drip irrigation mechanism.

7. The plant hanger of claim 6, wherein each of said plurality of hanger arms further comprises a hook affixed at a distal end for supporting said suspendable growing container.

8. The plant hanger of claim 6, wherein said fixed hub further comprises a groove disposed about said fixed hub circumference for receiving a length of securing wire; wherein said securing wire is threaded through a pair of first wire apertures disposed in each said hanger arm proximal end and wrapped around said fixed hub for attachment of said plurality of hanger arms.

9. The plant hanger of claim 8, wherein each of said first wire apertures further comprises a plastic liner disposed on an inner surface for reducing friction between said securing wire and said first wire apertures.

10. The plant hanger of claim 8, wherein said movable hub further comprises a groove disposed about said movable hub circumference for receiving a length of securing wire; wherein said securing wire is threaded through a pair of second wire apertures disposed in each said support arm proximal end and wrapped around said movable hub for attachment of said plurality of support arms.

11. The plant hanger of claim 10, wherein each of said second wire apertures further comprises a plastic liner disposed on an inner surface for reducing friction between said securing wire and said second wire apertures.

12. The plant hanger of claim 6, wherein said fixed hub is rigidly attached to said post portion end by a plurality of fixed hub brackets.

13. The plant hanger of claim 6, further comprising a post cap attachable to said post upper end for covering said manifold.

14. The plant hanger of claim 6, wherein said post further comprises a plurality of post apertures for receiving an insertable pin for securing said movable hub at a selected vertical position upon said post for adjustably positioning said plurality of hanger arms.

15. The plant hanger of claim 6, wherein said waterline extends outwardly from said base and is connectable to a water source, said waterline further comprises:

a water filter;

a pressure regulator;

a feed reservoir for storing vegetation nutrients to be mixed with said flow of water;

a shutoff valve.

16. The plant hanger of claim 15, further comprising a timer mechanism in fluid communication between said water source and said shutoff valve.

17. The plant hanger of claim 6, further comprising:

a tie-down affixed to said post; and, a tie-down rope having a tie-down hook disposed on at least one end;

wherein said tie-down rope is hangable from hook for preparing said suspendable growing container and hoisting said suspendable growing container to said hook.

* * * * *